United States Patent [19]

Freeman

[11] Patent Number: 4,767,291

[45] Date of Patent: Aug. 30, 1988

[54] SINGLE VALVE PUMP

[76] Inventor: John E. Freeman, P.O. Box 2119, Big Spring, Tex. 79271-2119

[21] Appl. No.: 82,228

[22] Filed: Aug. 6, 1987

Related U.S. Application Data

[63] Continuation of Ser. No. 3,241, Jan. 14, 1987, abandoned.

[51] Int. Cl.[4] ..... F04B 21/00; G05D 7/00

[52] U.S. Cl. ..... 417/560; 137/102

[58] Field of Search ..... 417/560, 447, 559, 457, 417/511, 518; 137/102

[56] References Cited

U.S. PATENT DOCUMENTS 2,347,887 5/1944 Commins ..... 417/531

*Primary Examiner*—William L. Freeh

*Attorney, Agent, or Firm*—Guy E. Matthews

[57] ABSTRACT

A down-hole pump adapted for operation in connection with a string of tubing and a string of reciprocating sucker rod. A pump includes a cylindrical housing connectable to the tubing and connected to a pump barrel; a piston rod connected to a piston disposed within the barrel and extending through the housing for connection to the sucker rod; a valve piston disposed in freely slidable relation within the barrel and around the piston rod between a down piston and an up piston; a base housing end connected to the bottom of the housing; and a top housing end connected to the top of the housing. A plurality of axially aligned liquid flow discharge openings are defined in the piston valve and the top housing end and circumferentially disposed on a first radius. A plurality of radially disposed intake openings are defined around the wall of the housing to be in flow registry with a circumferential groove defined around the wall of the valve piston when the valve piston is located in its down position and closed off from the groove when the valve is moved out of its down position. A plurality of axially aligned liquid flow intake openings are defined in the housing base and in the piston up into the circumferential groove and circumferentially disposed on a second radius larger than the first radius.

17 Claims, 3 Drawing Sheets

SINGLE VALVE PUMP

This is a continuation of application Ser. No. 3,241 filed Jan. 14, 1987, now abandoned.

SUMMARY OF THE INVENTION

The present invention relates to a simple down-hole positive displacement pump having a housing which connects to a production tubing string, a barrel connected to the housing, a plunger which reciprocates within the barrel and a single valve in the housing which is actuated by the flow of liquid in the housing and pump.

BACKGROUND OF THE INVENTION

Down-hole pumps have been used for a considerable period of time in the production of liquids from oil wells. Such pumps are generally of two types, electrically driven centrifical pumps located down in the well and reciprocating piston pumps driven by sucker rods from the surface. Both types are inserted in an oil well at the lower end of the production tubing string which carries the produced hydro-carbon liquid to the surface.

Both types of pumps have their drawbacks. The electrically driven pumps requires electrical conduit to carry power down-hole to the pump and special well-heads have been developed to accommodate the electrical connections required. See for example U.S. Pat. No. 3,473,149 issued to Cugini, et al.

The reciprocating piston-type pumps requires connection through the well-head to a reciprocating mechanism on the surface. The connection is through sucker rods which connect the piston rod of the down-hole pump to the surface unit. Sucker rods are known in the art and may be made of steel or fiberglass. Surface reciprocating units are common as evidenced by the many "grasshoppers" which may be seen in oil fields. The units may be of a variety of types, but one common type is the beam type pump as manufactured by Lufkin Industries or USS Oil Well.

Reciprocating plunger type down-hole pumps are known in the art. Some specific examples are illustrated in U.S. Pat. Nos. 615,470; 1,020,051; 1,156,882; 1,519,585; 1,550,963; 2,281,899; and 2,360,139.

All of the above disclosed pumps have a multiplicity of moving parts and/or sealing surfaces. Some, such as 2,281,899, for example, have specially designed check valves to prevent back-flow of oil on the intake stroke and others, such as 2,360,139, have double acting pistons for pumping fluids on both strokes of the plunger.

Wherever there is a sealing surface, there is a likelihood of a leak. Also, wherever there are moving parts, there is the possibility of wear. The highly corrosive atmosphere and abrasive material in the pump liquid contributes to leakage and wear. Simple pumps with few moving parts can be protected more easily against corrosion and abrasion, thus reducing leakage and wear.

None of the disclosed pumps has a simple single valve which operates in response to flow of liquid to open and close the intake-outlet at ports in one movement.

OBJECTS OF THE INVENTION

In view of the above considerations, it is one object of the present invention to provide a simple down-hole pump with few moving parts and sealing surfaces.

It is a further object of the invention to provide a single valve pump where wear parts are few and easily replaced.

DESCRIPTION OF THE PREFERRED EMBODIMENT

The preferred embodiment of the present invention is now shown in conjunction with reference to the figures wherein like numerals identify like elements.

Figure 1:
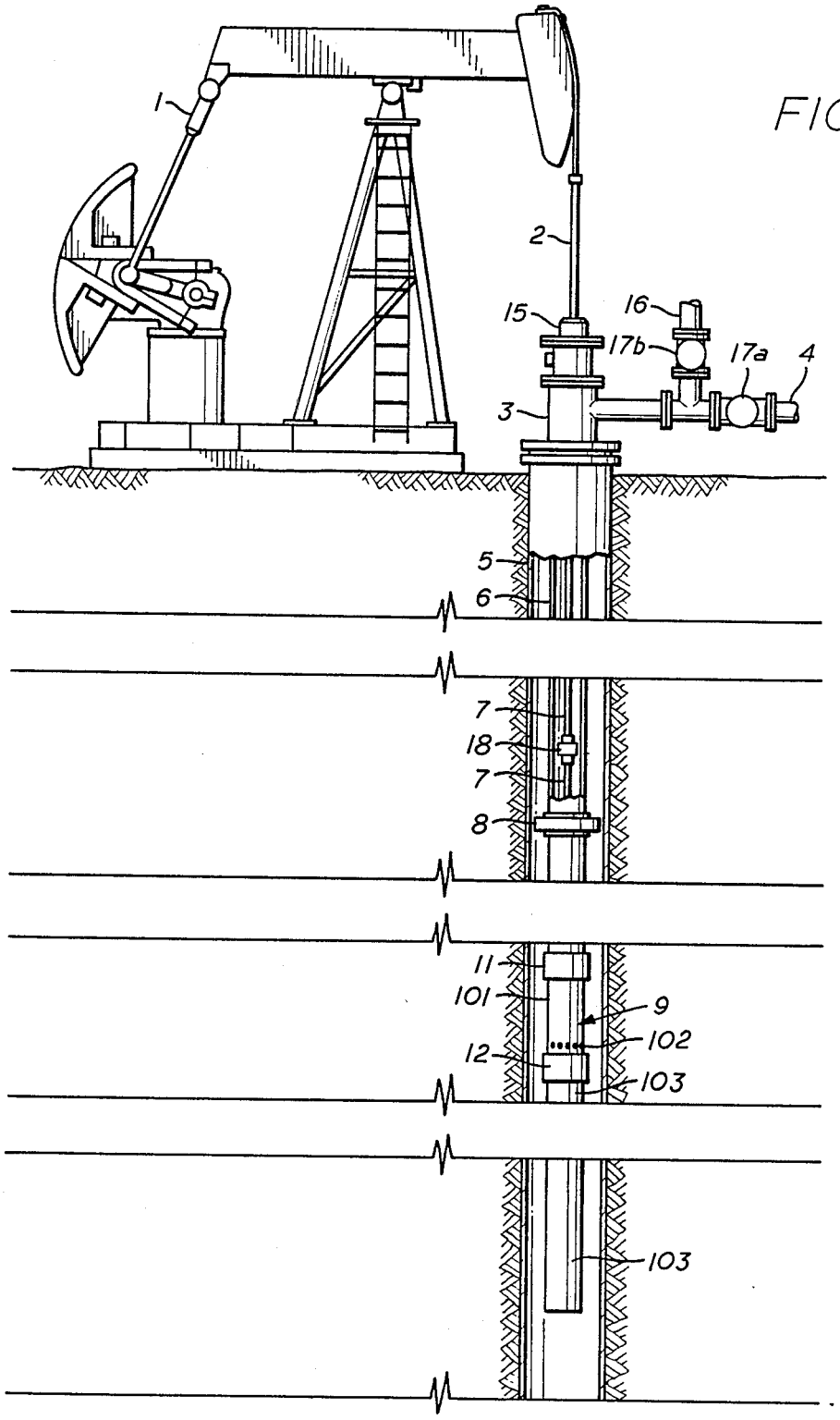
FIG. 1 is a schematic elevational view of a pump as installed in an oil well.

FIG. 1 shows the general arrangement of the pump 9 as installed in a producing oil well along with the equipment necessary for operation.

A typical surface pumping unit 1 is shown connected to the pump 9 by the polish rod 2 and the sucker rods 7. The polish rod 2 is shown passing through a packing gland 15 in the well-head 3. Generally, a guide 18 is used to center the sucker rods in the production tubing 6 as are tubing guides 8 used to center the tubing within the casing 5. The production tubing 6 is connected to the flow lines 4 and 16 within the well-head 3 with valves **17*a* and 17*b*** being used to direct the flow to the respective flow lines.

The pump 9 is connected to the production tubing at the housing 101 by collar 11 and to the barrel 103 by collar 12. The surface pumping unit 1 reciprocates the pump plunger within the barrel 103 through the sucker rods 7 and polish rod 2.

Referring now to FIGS. 2–6, a more detailed illustration of the pump as installed at the lower end of the production tubing 6 is shown. The pump housing 101 is shown connected to the lower end of the production tubing 6 by collar 11 which has internal threads 111 and 112 which match external threads on the tubing and housing respectively. The pump barrel 103 is likewise connected to the housing 101 by collar 12 which has identical threads 111 and 112 which connects to matching threads on the lower end of the housing and the upper end of the pump barrel.

The housing 101 has a series of inlet openings indicated at 102 within the walls of the housing. Internal of the housing is a sleeve 116 which may be intregally formed with the base 121 and connected to the top 120 by external threads 119 which match internal threads on the top 120. The base 121 is threadedly connected to the housing by means of threads 123. Spanner wrench holes 125 are formed in base 121 to permit ready assembly and disassembly.

Additionally, base 121 has openings 109 leading to the pumping chamber 110 which is formed by the plunger 104 within the barrel 103. Finally the top 120 has openings in the top 108 which lead into the production tubing 6. The plunger rod 105 is shown passing through the internal sleeve where it is connected to the sucker rods (not shown). Further, there is a shoulder 113 which forms a flow passageway connecting all of the openings 108 as shown.

The valve 106 is shown to be within the housing having an annular space 107 around the outer periphery of the body of the valve. Internal passageways 117 connect the peripheral annular space to the lower surface of the valve which are aligned with the openings 109 in the base of the housing. Additionally, within the valve itself are openings 118 which connect the top surface of the valve with the bottom surface and which align with the openings 108 in the top 120 of the valve housing.

Figure 4:
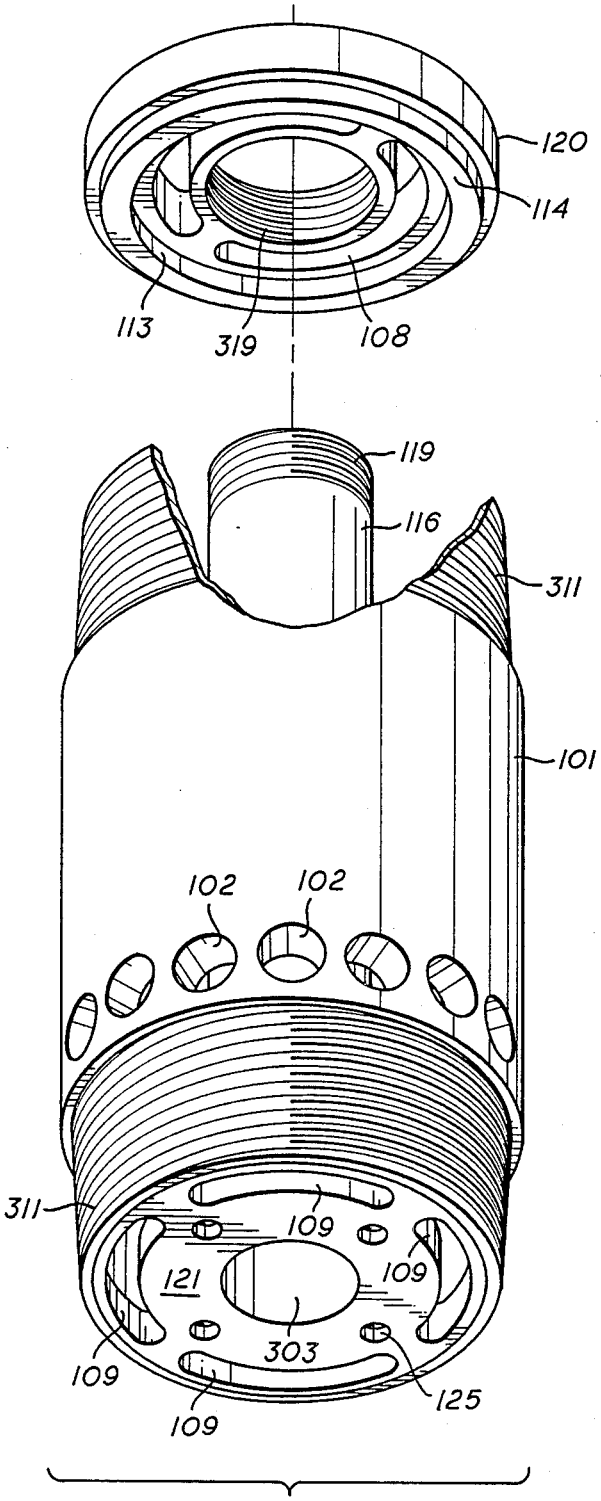
FIG. 4 is an exploded isometric view of the housing of the present pump.

The configuration of the valve housing itself may better be seen in FIG. 4. As shown, the housing 101 is essentially a cylinder having an inner sleeve 116 intregally formed with the base 121. An annular top 120 is threaded on to the inner sleeve 116 using internal threads 319 which match the external threads 119 on the sleeve 116. The openings 109 in the base 121 are more clearly shown to be elongated and all on a single radius. Likewise, the openings 108 in the top 120, are shown to be two elongated radial openings on a radius different from that of the openings in the base. The shoulder 113 is shown to provide a passageway between the two openings 108 in the top 120. A sealing surface 114 is shown in the top.

A series of circular holes 102 are disposed radially and on a common place in the wall of housing 101. These openings align with the inlet port 107 of the valve as more particularly outlined below. The sleeve 116 defines an inner opening through which the pump rod 105 passes as indicated at 303. The clearance between the inner cylindrical opening 303 and the pump rod 105 is such that lubrication is provided by a very small flow of oil within the clearance. Also shown are the threads 311 which match the lower threads 112 of the upper collar 11 and the upper threads 111 of the lower collar 12. Similarly, the internal threads 319 of the top 120 are shown which match the external threads 119 on the sleeve 116.

Figure 5:
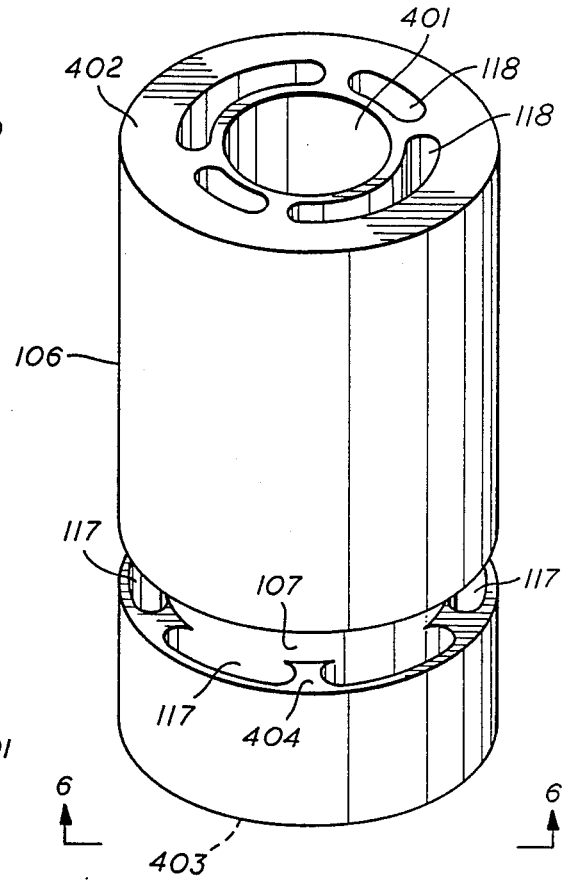
FIG. 5 is an isometric view of the single piston valve member used in the pump.
Figure 6:
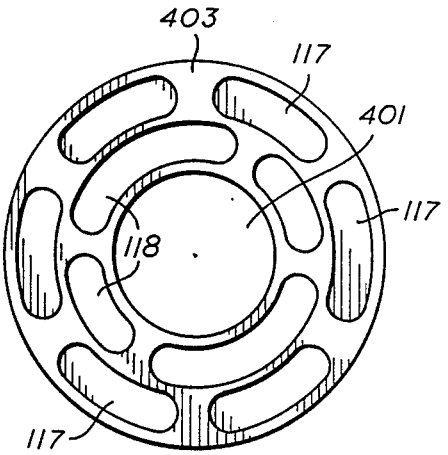
FIG. 6 is a bottom view taken along line A—A of FIG. 5 which indicates the location of the inlet and outlet ports.

Referring now to FIGS. 5 and 6, a more detailed illustration of the valve 106 is shown. The valve 106 is shown to be a substantially cylindrical solid piston having a central cylindrical opening 401 connecting top surface 402 with the bottom surface 403. At the lower end of the valve, is an annular peripheral opening or port 107. A series of elongated radial openings 117 are disposed between the top surface 404 of the annular opening 107 and the bottom surface 403. These elongated openings 117 are disposed on a radius substantially equal to the radius of the elongated radial openings 109 in the base 121 of the housing 101.

Additionally, with reference to FIGS. 5 and 6, there are elongated radial openings 118 which connect the top surface 402 of the valve to the bottom surface 403 and which are on substantially the same radius as the elongated openings 108 in the top 120. These openings are more clearly shown in FIG. 6 and their disposition about different radii more clearly identifiable. The elongation of these radial openings, taken into conjunction with elongation of the radial openings in the housing, allow for rotation of the valve within the housing and insure that there is always an overlap between radial openings 118 with radial openings 108 or an overlap between radial openings 117 with radial openings 109 in the base.

It is to be noted that the valve piston 106 may be desirably formed of dimensionally stable high strength plastics such as polypropylene or a polycarbonate. Actually, the entire pump assembly of components as attached to tubing 6 and sucker rod 7 may be formed of such high strength plastic for example.

It is to be noted that the circumferentially elongated openings, 117, 118, 108, and 109 as herein described can be substituted by series of adjacent holes drilled on the same radius and along the same circumference. The total flow area provided by such drilled holes would equal the areas illustrated.

The operation of these radial openings and the peripheral annular opening 107 are more fully explained in conjunction with FIGS. 1, 2 and 3 as follows.

Figure 2:
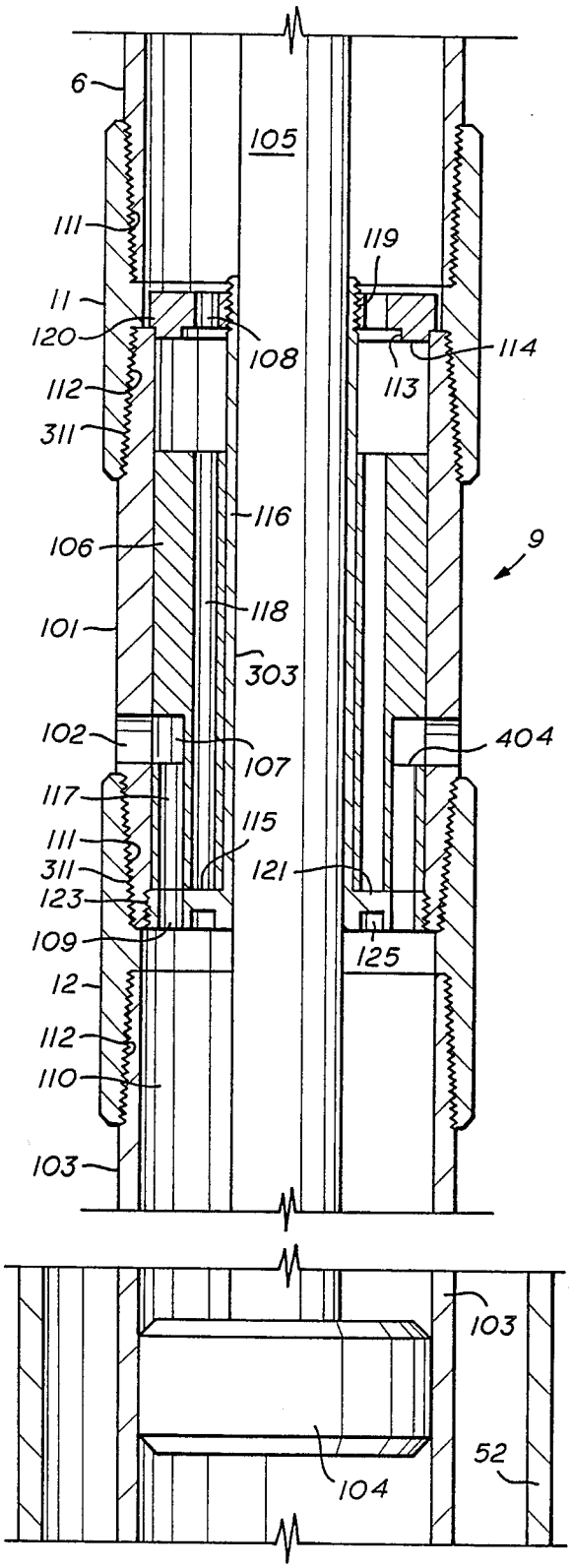
FIG. 2 is a side sectional view of the pump attached to production tubing showing the intake stroke.

FIG. 2 more particularly shows the barrel of the pump in the intake stroke while the piston 104 and rod 105 are moving down. During the intake, the weight of the fluid in the production tubing 6 causes the valve 106 to slide downwardly in the hcusing 101 and seat on the sealing surface 115. At the same time the annular opening 107 is aligned with the circular openings 102 within the wall of the housing, thus allowing fluid to flow into the valve and down through passageways 117 and openings 109 into the pumping chamber 110. The circumferential elongation of openings 117 and 109 insure that there will always be an overlap between the openings, allowing the fluids to flow into the pumping chamber.

Figure 3:
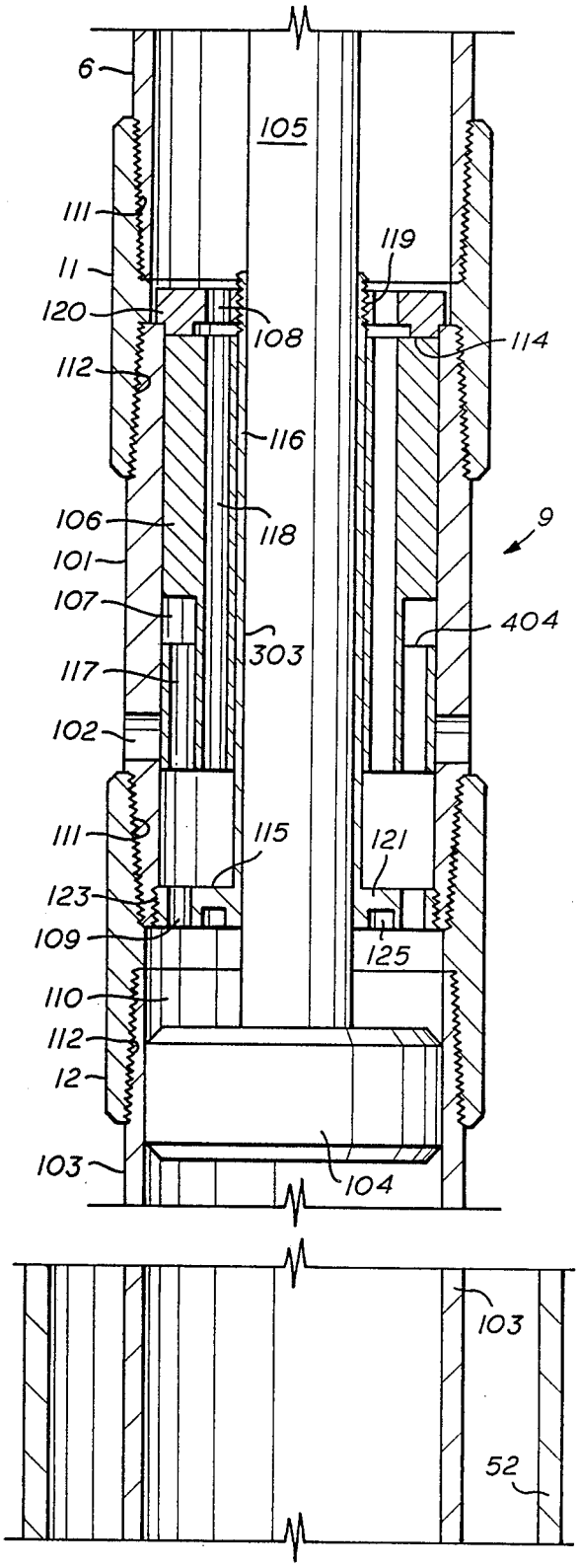
FIG. 3 is a side sectional view of the pump attached to a production tubing showing the exhaust stroke.

FIG. 3 shows the plunger in the exhaust stroke with piston 104 and rod 105 moving upwardly. As the plunger 104 rises, fluid is forced back through openings 109 to cause a differential flow pressure through the flow through openings 117, and consequently causes the valve 106 to rise in the housing above the openings 102 in the wall of the housing. As the valve is no longer seated on sealing surface 115 and the annular opening 109 is no longer aligned with openings 102, fluid is caused to flow through radial openings 118 and through radial openings 108 in the top of the housing. The further differential pressure through openings 118 pushes the valve further up into the housing and seats against sealing surface 114 of the top 120. The fluid then flows upward through the openings 108 of the top 120 into the production tubing 6 and out of the well.

As may be seen, a simple single valve is thus provided which operates in response to reciprocation and which is actuated by small flows of liquid within the pumping housing 101 and the pumping chamber 110.

It is to be noted, while only one embodiment of the invention is described and illustrated herein, that modifications and changes may be made while remaining within the spirit and purview of the invention as pointed out and specified by the appended claims.

What is claimed is:

1. In a down-hole pump for insertion into an oil well on the lower end of a production tubing string for pumping liquids, the combination comprising:

(a) a housing connectable to the lower end of said production tubing string, said housing having inlet means and outlet means;

(b) a pump barrel connected to the lower end of said housing;

(c) a plunger piston disposed within said barrel for axial reciprocating movement therein, said barrel and said plunger defining a pumping chamber;

(d) connection rod means extending through said housing for connecting said plunger piston to reciprocating means located above said housing; and (e) a single piston valve means disposed freely slidable within said housing, said valve means having at least one inlet port and one outlet port, said valve means having a top defining an upper surface, said upper surface having at least one outlet port, said valve means being operable in response to the flow of liquid within said pumping chamber and said housing such that when said pumping chamber begins to fill with liquid said inlet port aligns with said inlet means and when said plunger forces liquid from said pumping chamber into said housing, said outlet port aligns with said outlet means allowing liquid to flow into said production tubing string.

2. In a down-hole pump for insertion into an oil well on the lower end of a production tubing string for pumping liquids, the combination comprising:

(a) a housing connectable to the lower end of said production tubing string, said housing having inlet means and outlet means;

(b) a pump barrel connected to the lower end of said housing;

(c) a plunger piston disposed within said barrel for axial reciprocating movement therein, said barrel and said plunger defining a pumping chamber;

(d) connection rod means extending through said housing for connecting said plunger piston to reciprocating means located above said housing;

(e) a single piston valve means disposed freely slidable within said housing, said valve means having at least one inlet port and one outlet port, said vlave means being operable in response to the flow of liquid within said pumping chamber and said housing such that when said pumping chamber begins to fill with liquid said inlet port aligns with said inlet means and when said plunger forces liquid from said pumping chamber into said housing, said outlet port aligns with said outlet means allowing liquid to flow into said production tubing string;

(f) an inner cylindrical sleeve concentrically mounted within said housing to accommodate said connection means and defining an annular space between said inner sleeve and the inner wall of said housing;

(g) an annular base connecting said inner sleeve to said housing, said base defining a lower sealing surface;

(h) an annular top connection said inner sleeve to said housing, said top defining an upper sealing surface;

(i) a plurality of wall openings defined by the wall of said housing, each of said openings being disposed in a plane perpendicular to the cylindrical axis of said housing;

(j) a first plurality of circumferentially elongated openings defined through said base; and (k) a second plurality of circumferentially elongated openings defined by said top, the radius of said second plurality of elongated openings being less than the radius of said first plurality of elongated openings.

3. The down-hole pump of claim 2 wherein said valve further comprises:

(a) a substantially annular piston disposed freely slidable within said annular space, said piston being in substantially sealing engagement with the walls of said housing in said inner sleeve, said piston having a bottom defining a lower surface and a top defining an upper surface;

(b) a first plurality of elongated radial passageways connecting said upper surface and said lower surface; said first plurality of elongated passageways being in substantial vertical alignment with said second plurality of elongated radial openings;

(c) an annular space defined in the outer perimeter of said piston, said annular space being aligned with said plurality of wall openings when said lower surface is in sealing engagement with said lower sealing surface, said annular space defining an upper annular surface and a lower annular surface; and (d) a second plurality of elongated radial passageways connecting said lower annular surface and said lower surface, said second plurality of elongated radial passageways being in substantial vertical alignment with said first plurality of elongated radial openings.

4. A single valve pump for insertion into a well on the lower end of a production tubing string for pumping liquids, said pump comprising:

(a) a housing comprising an inner cylindrical sleeve concentrically mounted within said housing;

(1) an annular base connecting said inner sleeve to said housing, said base defining a lower sealing surface;

(2) annular top connecting inner sleeve to said housing, said top defining an upper sealing surface;

(3) a plurality of wall openings defined by the wall of said housing, and disposed in a plane perpendicular to the cylindrical axis of said housing, and defining an inlet means;

(4) a first plurality of circumferentially elongated openings defined by said base; and (5) a second plurality of circumferentially elongated openings defined by said top, the radius of said second plurality of elongated openings being less than the radius of said first plurality of elongated openings, and said second plurality of elongated openings defining an outlet means;

(b) a pump barrel connected to the lower end of said housing;

(c) a plunger piston disposed within said barrel for axial reciprocating movement therein, said barrel and said plunger defining a pumping chamber;

(d) connection means extending through said inner cylindrical sleeve for connecting said plunger piston to reciprocating means located above said housing; and (e) a single piston valve means disposed freely slidable within said housing, said valve means having at least one inlet port and one outlet port, said valve means being operable in response to the flow of liquid within said pumping chamber and said housing such that when said pumping chamber is filling with liquid said inlet port aligns with said inlet means and when said plunger forcing liquid from said pumping chamber into said housing, said outlet port aligns with said outlet means allowing liquid to flow into said production tubing string.

5. In a down-hole pump adapted for operation in connection with a string of tubing and a string of reciprocating sucker rod, the combination comprising:

(a) a cylindrical housing connectable to said tubing and connected to a pump barrel; a piston rod connected to a piston disposed within said barrel and extending through said housing for connection to said sucker rod; a valve piston disposed in freely slidable relation within said barrel and around said piston rod between a down position and an up position; a base housing end connected to the bottom of said housing; a top housing end connected to the top of said housing;

(b) a plurality of axially aligned liquid flow discharge openings defined in said piston valve and said top housing end and circumferentially disposed on a first radius;

(c) a plurality of radially disposed intake openings defined around the wall of said housing to be in flow registery with a circumferential groove defined around the wall of said valve piston when said valve piston is located in its down position and closed off from said groove when said valve is moved out of its down position;

(d) a plurality of axially aligned liquid flow intake openings defined in said housing base and in said piston up into said circumferential groove and circumferentially disposed on a second radius larger than said first radius;

(e) the flow area of said discharge openings within said piston valve being selected to create a differential pressure across said piston;

(i) to move said piston to an up position closing off said radially disposed intake openings with initial upward flow caused by upward movement of said plunger piston and;

(ii) move said piston to a down position closing off said axially aligned discharged ports against said bottom housing end with initial downward flow caused by downward movement of said plunger piston.

6. The combination of claim 5 wherein the top surface of said bottom end and the lower surface of said valve piston comprise matching valve seats.

7. The combination of claim 5 wherein including a supporting sleeve disposed within said housing in connection between said top housing end and said bottom housing end around said piston rod and within said valve piston; wherein said sleeve is formed integrally with said bottom housing end with said bottom housing end being in threaded connection with said housing; wherein said top housing end is in threaded connection with said sleeve and fixed to the top of said housing through said sleeve; and wherein the top surface of said bottom end and the lower surface of said valve piston comprise matching valve seats.

8. The combination of claim 5 further including a supporting sleeve disposed within said housing in connection between said top housing end and said bottom housing end around said piston rod and within said valve piston.

9. The combination of claim 6 wherein said sleeve is formed integrally with said bottom housing end with said bottom housing end being in threaded connection with said housing.

10. The combination of claim 9 wherein said top housing end is in threaded connection with said sleeve and fixed to the top of said housing through said sleeve.

11. The combination of claim 10 wherein the top surface of said bottom end and the lower surface of said valve piston comprise matching valve seats.

12. The combination of claim 5 wherein said valve piston is formed of plastic material.

13. The combination of claim 12 wherein said plastic is polypropylene.

14. The combination of claim 12 wherein said plastic is a polycarbonate.

15. The combination of claim 5 wherein all the elements of said combination connected with said tubing and said sucker rod are formed of a high strength, dimensionally stable plastic.

16. The combination of claim 15 wherein said plastic is a polycarbonate.

17. The combination of claim 15 wherein said plastic is a polypropylene.

* * * * *